United States Patent [19]

Aguilera

[11] Patent Number: 4,624,439

[45] Date of Patent: Nov. 25, 1986

[54] APPARATUS FOR MANUFACTURING CONCRETE POSTS

[76] Inventor: Enoc C. Aguilera, 1990 Wainwright Rd., Stevinson, Calif. 95374

[21] Appl. No.: 357,649

[22] Filed: Mar. 12, 1982

Related U.S. Application Data

[63] Continuation-in-part of Ser. No. 213,741, Dec. 5, 1981, abandoned.

[51] Int. Cl.[4] ..... B28B 7/04

[52] U.S. Cl. ..... 249/48; 249/51; 249/95; 249/97; 249/139; 249/143; 249/171

[58] Field of Search ..... 249/170, 171, 147, 143, 249/148, 91, 96, 97, 48, 51, 95, 139; 425/84

[56] References Cited

U.S. PATENT DOCUMENTS

| | | | |
|---|---|---|---|
| 811,310 | 1/1906 | Maag | 249/185 X |
| 821,031 | 5/1906 | DyArman | 249/14 |
| 834,448 | 10/1906 | Brooks | 249/143 |
| 856,866 | 6/1907 | Hart | 249/171 X |
| 920,017 | 4/1909 | Bruner | 249/96 X |
| 992,311 | 5/1911 | Westlake | 249/143 X |
| 1,323,689 | 12/1919 | Granger | 249/143 |
| 1,417,644 | 5/1922 | Tyler | 249/91 |
| 1,601,379 | 9/1926 | Swan | 249/96 X |
| 2,586,413 | 2/1952 | Antonello | 249/171 |
| 3,071,835 | 1/1963 | Tumey | 249/171 |
| 3,348,802 | 10/1967 | Corbett | 249/171 |
| 3,415,482 | 12/1968 | Schmidgall | 249/145 |
| 3,428,287 | 2/1969 | Redding et al. | 249/171 |
| 3,577,613 | 5/1971 | Hidden | 249/86 |
| 3,656,729 | 4/1972 | Borgert | 249/18 |
| 3,785,607 | 1/1974 | Worker et al. | 249/171 X |
| 4,022,859 | 5/1977 | Fioretto | 264/69 |
| 4,067,941 | 1/1978 | Gaudelli et al. | 264/69 |

*Primary Examiner*—Jay H. Woo
*Assistant Examiner*—James C. Housel
*Attorney, Agent, or Firm*—Harvey B. Jacobson

[57] ABSTRACT

A base is provided including first, second and third adjoining marginal portions and a first stationary upstanding wall is fixedly secured to and projects upwardly from one of the marginal portions. Second and third upstanding walls are provided and pivotally supported along upstanding base edge marginal portions thereof from remote upstanding marginal edge portions of the stationary wall for swinging movement of the remote free upstanding marginal edges of the second and third walls toward and away from closely juxtaposed positions defining a peripherally enclosed upstanding mold cavity above the base between the first, second and third upstanding walls. The lower edges of the second and third walls are disposed in reasonably good sealed relation with the second and third marginal portions of the base. The base defines an upwardly opening socket centrally disposed relative to the cavity and an upstanding reinforcing member is provided and has its lower end received in the socket. An upper end portion of the reinforcing member includes a horizontally outwardly projecting shank supported therefrom and at least one of the free marginal edges of the second and third walls has a notch formed therein opening toward the free marginal edge of the other of the second and third walls through which the outer end of the shank projects. Horizontally aligned openings may be provided in remote wall portions of the mold and have the opposite ends of a horizontal sleeve projecting outwardly therethrough.

12 Claims, 22 Drawing Figures

FIG. 4
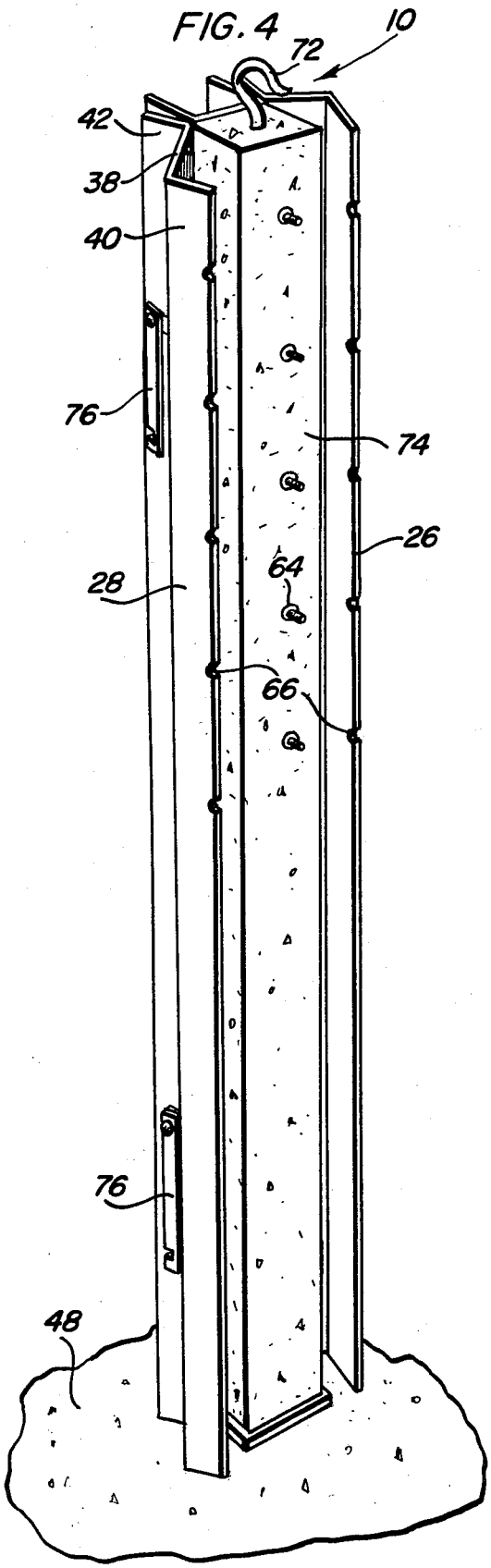
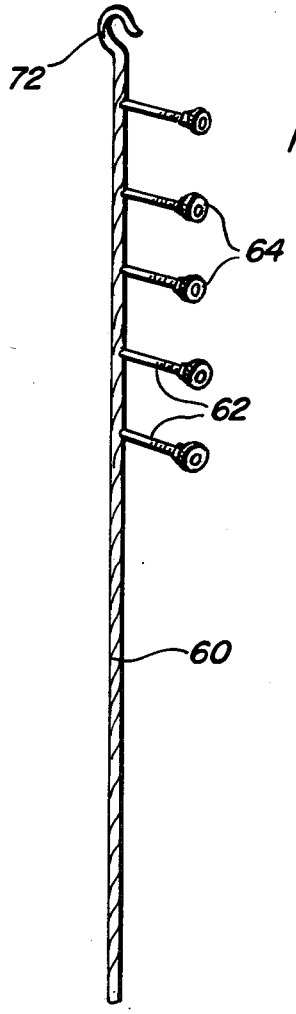
FIG. 5
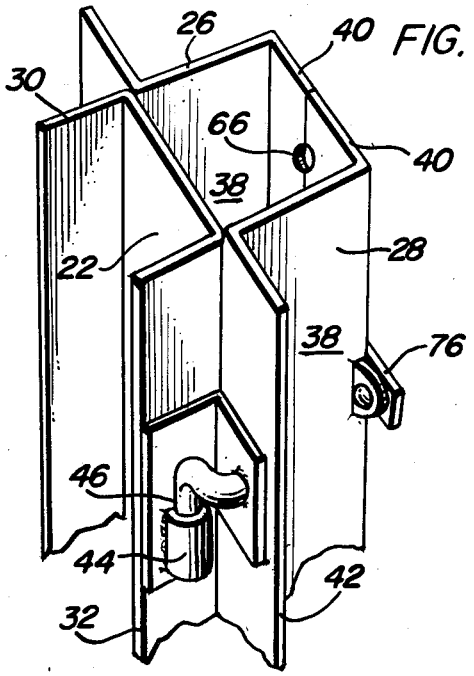
FIG. 6

Fig. 15
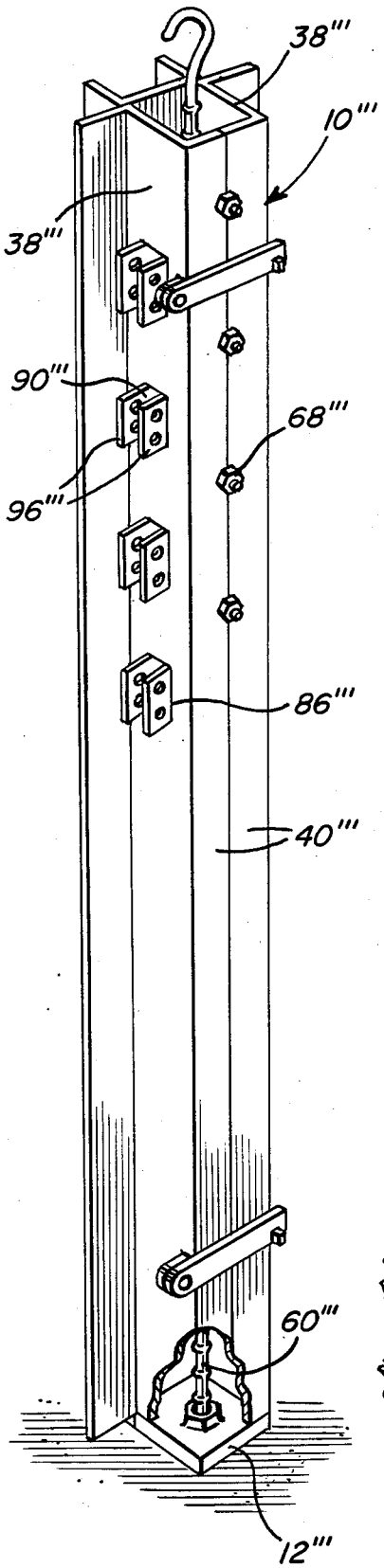
Fig. 16
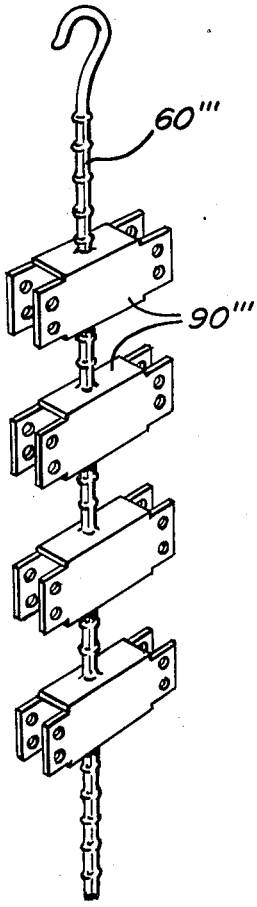
Fig. 17
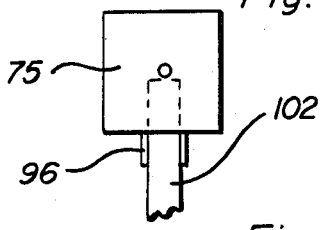
Fig. 18
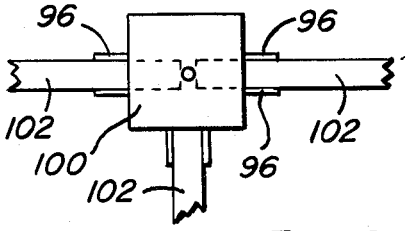
Fig. 19
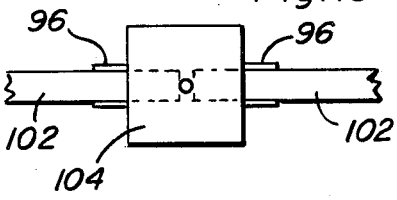
Fig. 20
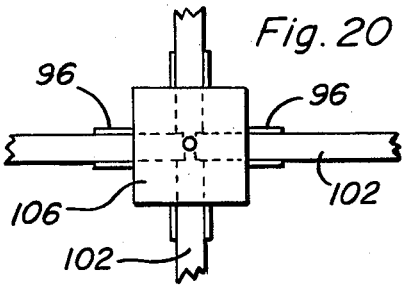
Fig. 21
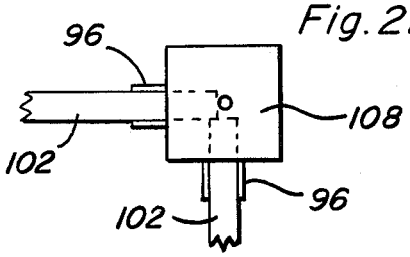
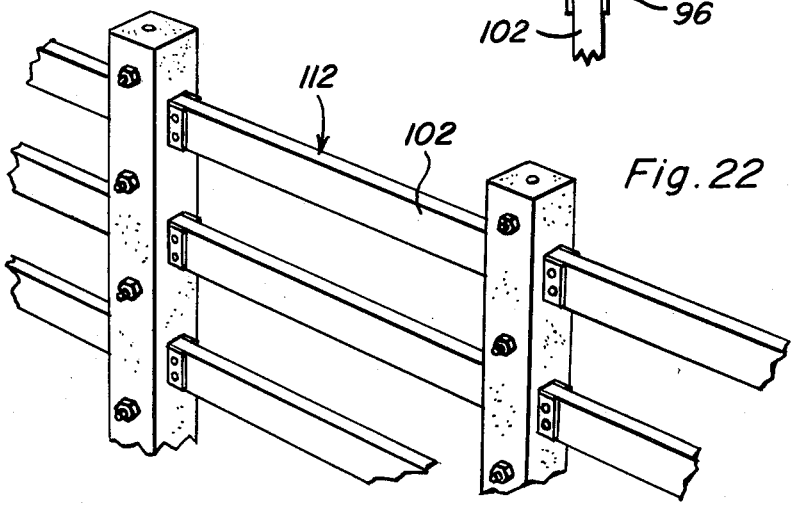
Fig. 22

APPARATUS FOR MANUFACTURING CONCRETE POSTS

BACKGROUND OF THE INVENTION

This application comprises a continuation-in-part of U.S. application Ser. No. 213,741, filed Dec. 5, 1981, now abandoned.

Most fence constructions utilize wood posts in view of the ability to incorporate wood posts in various types of fence constructions and the relatively low expense of wooden posts. Metal posts may be used for wire fences, but may not be readily incorporated, either structurally or aesthetically, in wooden fences. In addition, cementitious fence posts heretofore have been known, but difficulties in molding or casting cementitious fence posts and the difficulty of adapting cement fence posts for use in wire fences has rendered the use of cementitious fence posts minimal, even though a cementitious fence post will last almost indefinitely.

Accordingly, a need exits for an improved structure and method for molding or casting cementitious fence posts and wherein the structure and method involved may be utilized to mold or cast cementitious fence posts which may be used in conjunction with wooden fences or wire fences, as desired.

Examples of various methods and structures for molding or casting cementitious posts are dislcosed in U.S. Pat. Nos. 821,031, 834,448, 1,323,689, 2,586,413, 3,071,835, 3,348,802, 3,428,287, 3,577,613, 3,656,729, 3,785,607, 4,022,859 and 4,067,941.

BRIEF DESCRIPTION OF THE INVENTION

The instant invention provides an upstanding mold including a base having first, second and third adjacent marginal portions and including a stationary upstanding wall supported therefrom projecting upwardly from the first marginal portion of the base. Second and third upstanding walls are pivotally supported from remote upstanding marginal edge portions of the first wall and include first upstanding edge portions which are swingable toward and away from closely juxtaposed positions with the three upstanding walls defining an upstanding mold cavity above the base.

The base includes an upwardly opening socket centrally located relative to the cavity in which the lower end of an upstanding reinforcing member is downwardly telescoped and the upper end of the reinforcing member includes a horizontally outwardly projecting shank whose outer end projects through a notch formed in at least one of the free edges of the second and third upstanding walls.

The second and third upstanding walls are pivotally supported from the first upstanding wall for a limited vertical shifting relative thereto and the lower edges of the second and third walls overlie the second and third marginal edges of the base when the free edges of the second and third walls are disposed in closely juxtaposed postion. The weight of the second and third walls enables the lower edges of those walls to bear tightly downwardly upon the upper surface of the corresponding marginal edges of the base in order to form a reasonably good sealed engagement therewith.

The invention also contemplates the provision of remote wall portions of the mold with horizontally registered openings through which the opposite ends of a sleeve extending through the mold cavity may project and the sleeve is therefore molded in the cementitious post being cast in order that the opposite ends of generally horizontally registered fence boards may be seated within the opposite ends of the sleeve when a plurality of posts are incorporated in a wood fence being erected. The outer ends of the horizontal shanks carried by the reinforcing member project outwardly beyond the corresponding outer surfaces of the finished posts and may thus be used to anchor wire strands to the posts when erecting wire fences. Further, the upper end of the reinforcing member may have an anchor structure temporarily supported therefrom whereby the finished cementitious posts may be lifted from above.

The main object of this invention is to provide an improved method and apparatus for forming cementitious posts.

Another object of this invention is to provide a method and apparatus for forming cementitious posts which may be used either in constructing a wooden fence or a wire fence.

Another important object of this invention is to provide a method and apparatus of forming a cementitious post including provisions whereby horizontal passages may be provided in the resultant posts for receiving wooden fence boards therethrough.

Yet another object of this invention is to provide a method and apparatus of constructing cementitious fence posts and which incorporates provision for attaching fence wire to the posts at predetermined locations spaced therealong.

A further important object of this invention is to provide a method and apparatus for forming cementitious posts such that posts of varying lengths may be provided.

Yet another object of this invention is to provide a method and apparatus for forming cementitious posts and wherein the same basic apparatus and method may be utilized to form posts of different cross-sectional shapes.

A final object of this invention to be specifically enumerated herein is to provide a method and apparatus for forming cementitious posts which will conform to conventional forms of manufacture, be relatively trouble free and enable the desired fence post to be formed with a minimum of effort.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 4 is a further perspective view of the mold illustrated in FIG. 1 with the swingable wall portions thereof being in open position and a molded post ready to be removed from the mold;

FIG. 5 is a perspective view of the reinforcing member utilized in the construction of the post;

FIG. 6 is an enlarged fragmentary perspective view of the upper end of the post with the swingable wall portions thereof illustrated in the closed positions;

FIG. 15 is a perspective view of yet another mold which may be used in the construction of a fence post to be incorporated in a wooden fence;

FIG. 16 is a fragmentary perspective view of a post reinforcing member such as that which may be used in conjunction with the mold illustrated in FIG. 15;

FIGS. 17 through 21 are top plan views of posts molded through utilization of molds such as those illustrated in FIGS. 10 and 15 and illustrating the various ways in which the posts may be incorporated in wooden fences; and FIG. 22 is a perspective view of a portion of a wooden fence constructed through the utilization of the mold illustrated in FIG. 15.

DETAILED DESCRIPTION OF THE INVENTION

Figure 1:
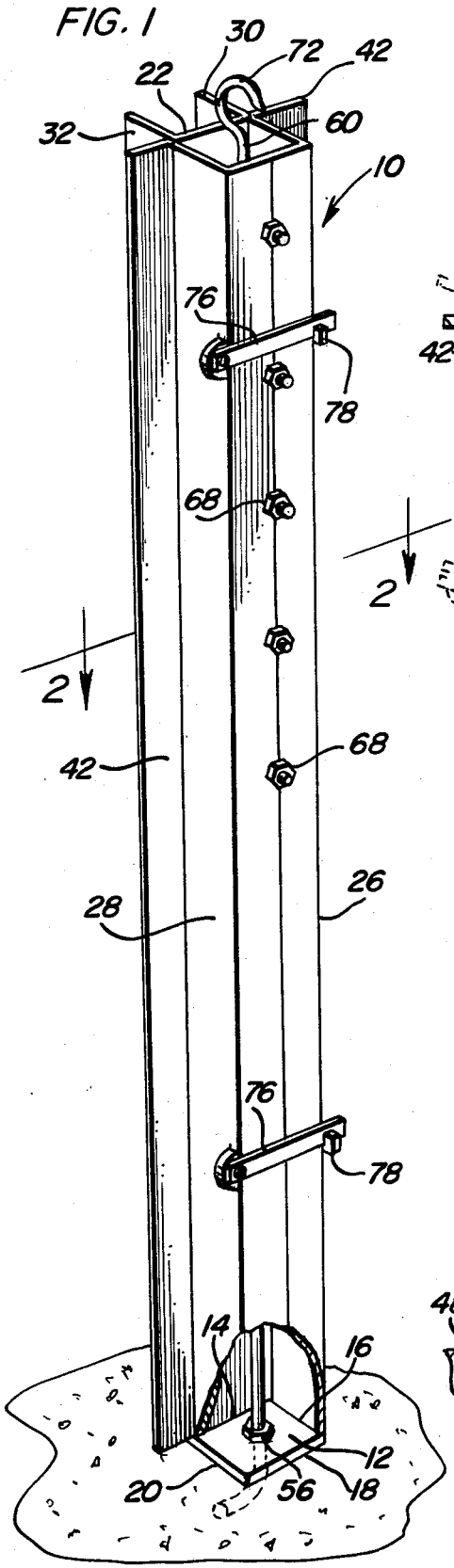
FIG. 1 is a perspective view of a first form of mold in accordance with the present invention with parts of the mold being broken away and illustrated in vertical section.
Figure 2:
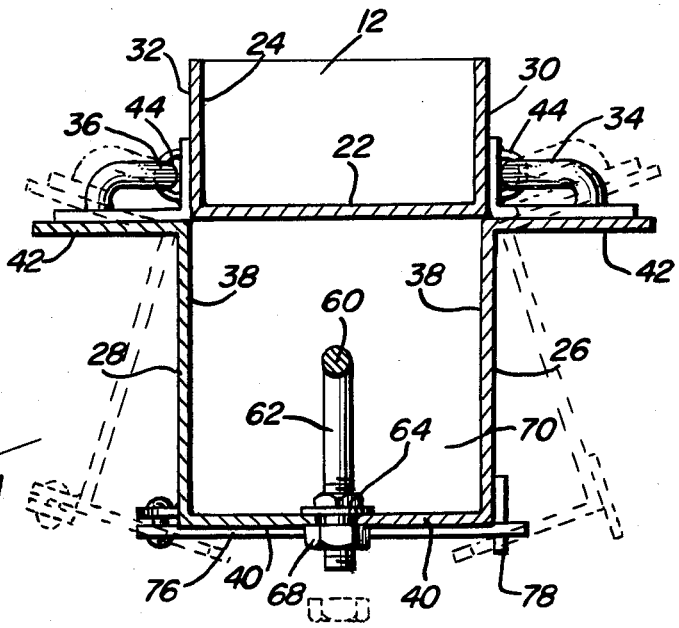
FIG. 2 is an enlarged horizontal sectional view taken substantially upon the plane indicated by the section line 2—2 of FIG. 1.

Referring now more specifically to the drawings, the numeral 10 generally designates a first form of mold constructed in accordance with the present invention. The mold 10 includes a horizontal base plate 12 of substantially square plan shape and including first, second, third and fourth sides or marginal edges 14, 16, 18 and 20. The side or marginal edge 14 comprises a first marginal portion, the side or edge 16 and the adjacent half of the edge 18 comprises a second marginal portion while the side 20 and the adjacent half of the side 18 defines a third marginal portion. A first stationary upstanding wall 22 comprising the bight portion of a rearwardly opening channel member 24 is secured to and projects upwardly from the side or marginal edge 14 of the base plate 12. A pair of opposite side, generally Z-shaped wall assemblies 26 and 28 are provided and swingably supported from the corresponding flanges 30 and 32 of the channel member 24 through the utilization of vertically spaced hinge assemblies 34 and 36. The wall assemblies 26 and 28 are swingable between the closed positions thereof illustrated in solid lines in FIG. 2 and the open positions thereof illustrated in phantom lines in FIG. 2. The wall assemblies 26 and 28 each define a pair of right angular walls including side flanges 38 formed integrally with and extending along first base marginal edges of the right angular walls and partial front flanges 40 in addition to base flanges 42 by which the wall assemblies 26 and 28 are hingedly supported from the flanges 30 and 32. The side flanges 38 include base marginal edge portions from which the base flanges 42 are supported and the opposing vertical edges of the partial front flanges 40 define free edges of the wall assemblies 26 and 28 which are swingable toward and away from each other to close and open the mold 10.

Each of the flanges 30 and 32 includes a plurality of vertically spaced sleeves 44 supported therefrom, see FIG. 6, and each base flange 42 includes a plurality of laterally offset depending shank portions 46 supported therefrom and rotatably and longitudinally slidably received in the corresponding sleeves 44, corresponding sleeves 44 and shank portions 46 defining the hinge assemblies 34 and 36. Accordingly, the wall assemblies 26 and 28 may not only swing horizontally between the phantom and solid line positions thereof illustrated in FIG. 2 but may also shift slightly vertically relative to the stationary wall 22. Thus, the lower marginal edges of the side flanges 38 and the partial front flanges 40 bear downwardly upon the corresponding upper surface portions of the base plate 12 and serve to form a reasonably good fluid tight seal between the wall assemblies 26 and 28 and the base plate 12 when the wall assemblies 26 and 28 are in their closed positions.

Figure 3:
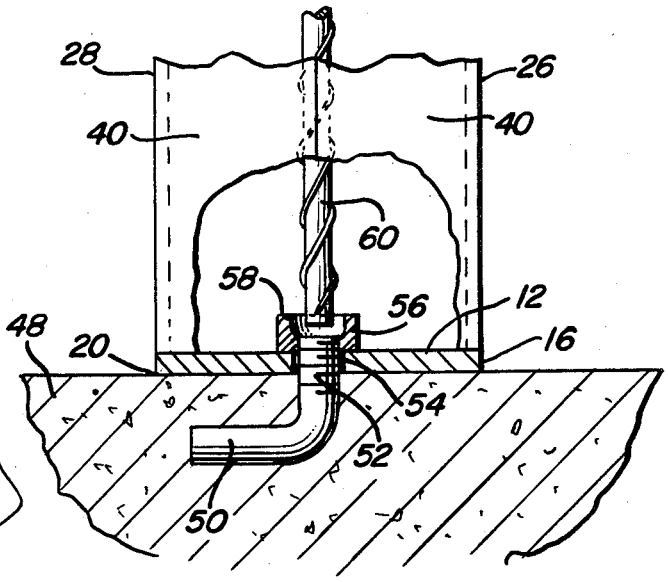
FIG. 3 is a fragmentary enlarged elevation of the lower end portion of the mold illustrated in FIGS. 1 and 2 and with portions thereof being broken away and illustrated in vertical sections.

With attention invited more specifically to FIG. 3 of the drawings, it may be seen that the base plate 12 may be secured to a suitable support surface such as a concrete floor 48 through the utilization of a floor anchor including an upwardly projecting threaded shanks 52 projecting upwardly through the upper surface of the floor 48 and upwardly through a central bore 54 formed in the base plate 12 over which a threaded nut 56 is disposed. The nut 56 has its lower end threadedly engaged on the shank 52 and the upper end of the nut 56 includes an enlarged interior 58 defining an upwardly opening recess above the upper end of the shank 52 in which the lower end of a reinforcing rod 60 may be received.

The reinforcing rod 60 includes a plurality of vertically spaced and forwardly projecting shank portions 62 supported from its upper end portion and the outer end of each shank portions 62 is externally threaded and includes a threaded abutment 64 mounted thereon. The second free marginal edges of the partial front flanges 40 remote from the flanges 42 include registered vertically spaced notches 66 opening toward each other and the portions of the shank portions 62 disposed immediately outwardly of the abutment 64 are closely embraced by the notches 66 and outer retaining nuts 68 are then threaded on the outer end of the shank portions 62 and tightened against the free edges of the partial front flanges 40 in order to secure the latter in the close positions thereof illustrated in FIG. 2 of the drawings. In this manner, a mold cavity 70 of substantially square cross section is formed above the base plate 12 and the reinforcing rod 60 is securely held in position against lateral displacement as a result of the pouring of cementitious material into the cavity 70 from the upper end of the mold 10.

The upper end of the reinforcing rods 60 may have a hook 72 temporarily secured thereto by welding and in this manner the post 74 (see FIG. 4) formed in the mold 10 may be readily lifted therefrom. Further, it may be seen that the wall assembly 28 includes a pair of vertically spaced latch bars 76 supported therefrom and that each latch bar 76 is swingable into and out of engagement with a corresponding locking lug 78 carried by a corresponding portion of the wall assembly 26. In this manner, the wall assemblies 26 and 28 may be latched in the close positions thereof with the notches 66 closesly embracing the outer end portions of the shank portions 62 while the retaining nuts 68 are threaded into position.

Figure 9:
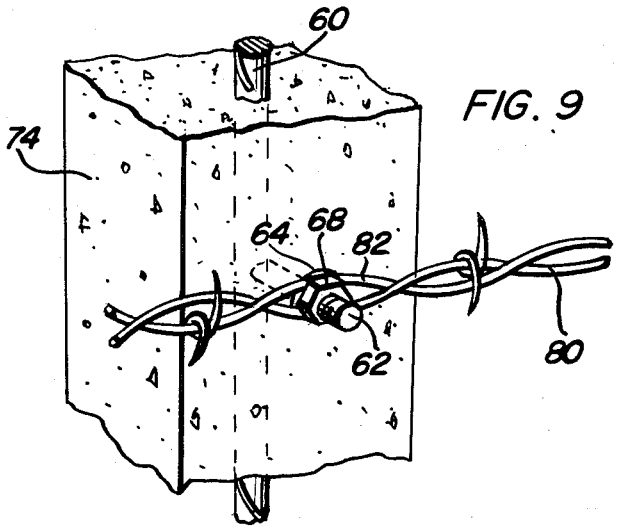
FIG. 9 is a fragmentary enlarged perspective view of a finished post constructed through the utilization of the mold illustrated in FIGS. 1 through 6 and illustrating the manner in which a section of barbed wire may be anchored relative to the post.
Figure 10:
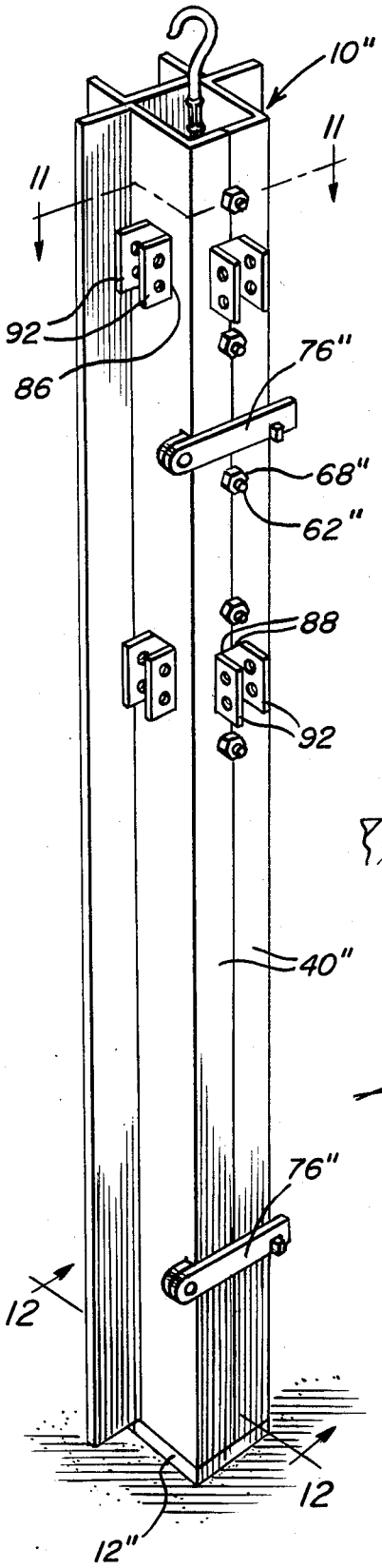
FIG. 10 is a perspective view of a third form of mold utilized in the construction of a corner post for a wire fence and with the corner post including structure for bracing by adjacent posts through the utilization of horizontal fence boards connected between the corner posts and the adjacent posts.
Figure 11:
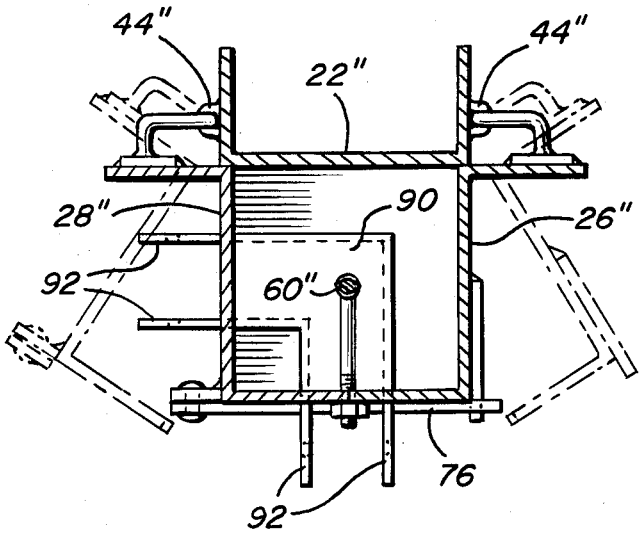
FIG. 11 is an enlarged horizontal sectional view taken substantially upon the plane indicated by the section line 11—11 of FIG. 10 and with the open positions of the swingable wall portions of the mold illustrated in phantom lines.
Figure 12:
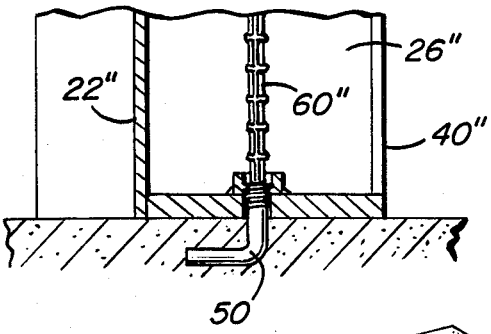
FIG. 12 is an enlarged fragmentary vertical section view taken substantially upon the section line 12—12 of FIG. 10.
Figure 13:
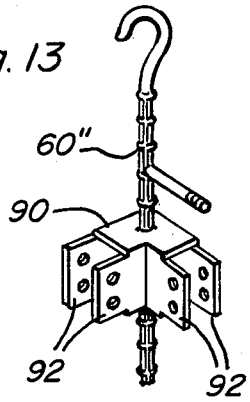
FIG. 13 is a perspective view of the upper portion of the post reinforcing member utilized in the mold illustrated in FIG. 10.

With attention now invited more specifically to FIG. 9 of the drawings, it may be seen that a section of twisted wire 80 may be slightly spread as at 82 and disposed over the extended end of one of the shank portions 62 against the abutment 64 and that thereafter one of the nuts 68 may be threadedly engaged with the shank portions 62 in order to retain the twisted wire section 80 in position on the post 74.

Figure 7:
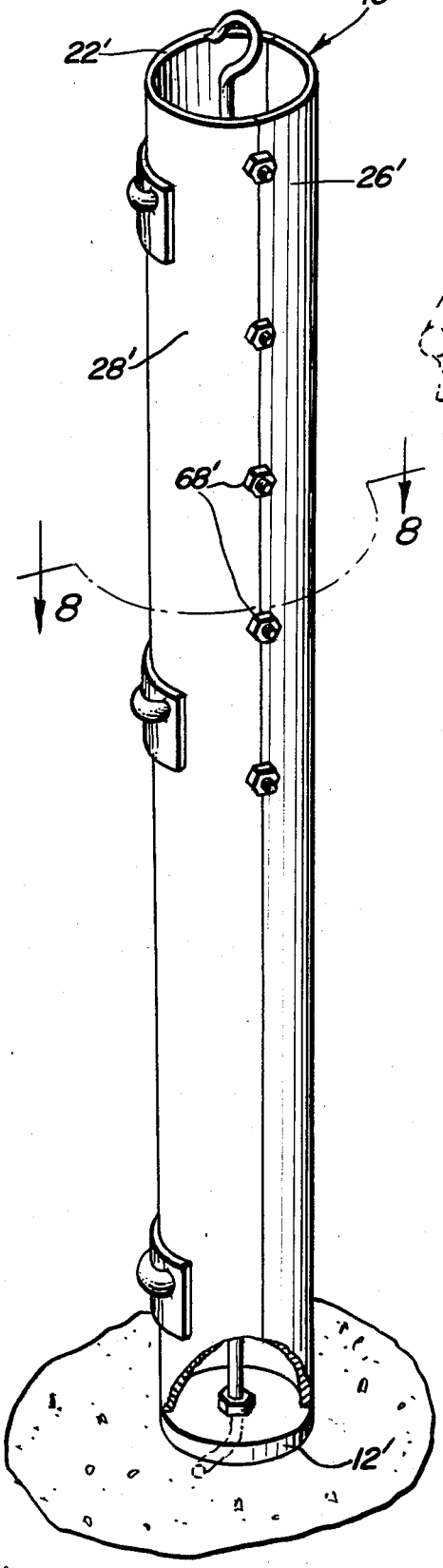
FIG. 7 is a perspective view of a second form of mold which may be utilized to construct a cylindrical post.
Figure 8:
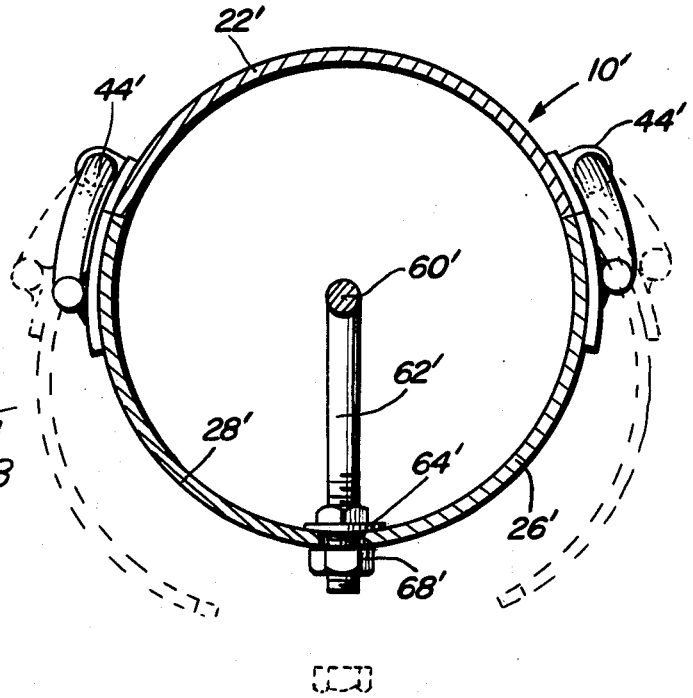
FIG. 8 is an enlarged horizontal sectional view taken substantially upon the plane indicated by the section line 8—8 of FIG. 7.

With attention now invited more specifically to FIG. 7 of the drawings, there may be seen a modified form of mold referred to in general by the reference numeral 10'. The mold 10' is substantially identical to the mold 10, except that the base plate 12' thereof is circular in cross section and the first stationary wall 22' is arcuate in cross section. Further, the wall assemblies 26' and 28' corresponding to the wall assemblies 26 and 28 are also arcuate in cross section. In this manner, the mold 10' may be utilized to form cylindrical cementitious posts.

With attention now invited more specifically to FIGS. 10 through 14 of the drawings, there may be seen a third form of mold referred to in general by the reference numeral 10''. The mold 10'' is a substantial duplicate of the mold 10 except that the side flanges 38'' thereof have vertically spaced horizontal side openings 86 formed therein and the partial front flanges 40'' thereof have opposing large notches 88 formed therein defining corresponding front openings. A plurality of horizontal L-shaped sleeves 90 are provided and welded in position on a reinforcing rod 60'' corresponding to the reinforcing rod 60 with the opposite ends of the sleeves projecting through the openings 86 and the corresponding openings formed by each pair of opposing notches 88. The opposite ends of the sleeves 90 include apertured mounting flanges 92 which project outwardly of the corresponding openings and may be used to secure wooden fence rail ends in the corresponding sleeve ends.

Figure 14:
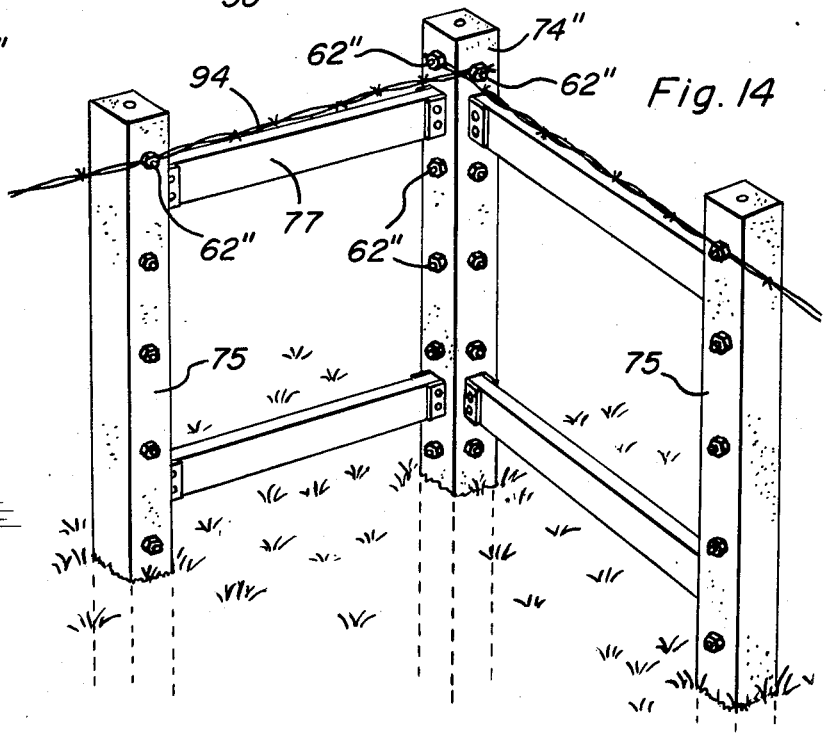
FIG. 14 is a perspective view of a wire fence construction incorporating a corner post molded through the utilization of the mold illustrated in FIG. 10 and with the corner post being braced in two directions by adjacents posts.

With attention now invited more specifically to FIG. 14 of the drawings, it may be seen that a corner post 74'' may be braced by a pair of adjacent similar corner posts 75 and two sets of upper and lower fence boards may be 77 secured between the post 74'' and the posts 75. Of course, suitable fasteners may be secured through the flanges 92 and the fence boards 77.

By using three posts at each corner of a fence in the manner illustrated in FIG. 14, the corner post 74'' is greatly reinforced and the corresponding fence runs may be either of wire construction or board fence construction. However, in FIG. 14 a wire fence construction is illustrated with a twisted strand of wire 94 secured to and extending between the upper shank portions 62'' supported from the fence posts 74 and 75. A fence post 75 is also illustrated in FIG. 17 of the drawings, and it will be noted that the fence post 75 includes shorter sleeves 96 corresponding to the sleeves 90 and which define sockets in the posts 75 closed at their inner ends for receiving the corresponding ends of the fence boards 77.

In FIG. 18 of the drawings, it may be seen that three sleeves 96 may be used on a post 100 into which fence boards 102 may be inserted from three 90° relatively angularly displaced positions.

In FIG. 19, there may be seen a fence post 104 including a pair of aligned sleeves 96 which may be utilized on the post 104 in order to define oppositely outwardly opening sockets for receiving adjacent fence boards 102.

With attention now invited more specifically to FIG. 20 of the drawings, it may be seen that a fence post 106 may be provided and utilize four sleeves 96 to receive fence boards 102 from four relatively angularly displaced positions and from FIG. 21 of the drawings, it may be seen that a fence post 108 may be provided utilizing a pair of right angularly disposed sleeves 96 in order to receive a pair of fence boards disposed at 90° relative to each other. Of course, the fence post 108 is similar to the fence post which may be formed by utilization of the mold 10' wherein a plurality of right angle sleeves 90 are used.

With attention now invited more specifically to FIG. 15, there may be seen a mold referred to in general by reference numeral 10'''. The mold 10''' is very similar to the mold 10' except that the reinforcing rod 60''' used in conjunction therewith includes a plurality of straight sleeves 90''' in lieu of the right angular sleeves 90. The opposite ends of the sleeves 90''' are received through openings 86''' formed in the side flanges 38''' of the mold 10''' corresponding to the side flanges 38 of the mold 10. Accordingly, a fence post made through the utilization of the mold 10''' is substantially identical to the fence post 104 illustrated in FIG. 19. The only difference between the fence post 104 and a fence post constructed through utilization of the mold 10''' is that the fence post 104 uses a pair of close ended sleeves 96 abutted against and secured to the corresponding reinforcing rod whereas the fence post molded in the mold 10''' uses the sleeves 90''' through which the corresponding reinforcing rod 60''' extends.

With attention now invited more specifically to FIG. 22, it may be seen that either the posts 104 or a post produced from the mold 10''' may be used in constructing the fence run 112 illustrated in FIG. 22. The fence run 112 includes a pair of suitable posts between which three vertically spaced horizontal fence boards 102 are secured.

It is to be noted that various materials may be used in the construction of the wall assemblies 26 and 28 and the stationary wall 22. However, although certain other materials such as plastic may be used, it is preferable that these components of the molds be constructed of metal. Furthermore, it is envisioned that a plurality of the molds may be permanently anchored in upstanding relation from the floor 48 and successively provided with reinforcing rod structures such as that disclosed hereinabove and thereafter successively filled to the desired level with a cementitious material. In this manner, a plurality of posts may be formed in an assembly line manner in order to greatly reduce the cost of each post. Furthermore, the notches 66 may be provided with resilient seal components or a thin resilient annular seal may be used between the outer surfaces of the abutments 64 and the opposing inner surfaces of the partial front flanges 40. Also, the ends of the side flanges 38 adjacent the base flanges 42 and the stationary wall 22 may have beads of sealing material extending therealong whereby movement of the wall assemblies 26 and 28 to the close positions thereof illustrated in FIG. 2 will assure a substantially fluid tight seal between the wall assemblies 26 and 28 and the stationary wall 22.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A mold in which to cast cementitious posts, said mold including a base having first, second and third adjoining marginal portions extending about said base, a first stationary upstanding wall fixedly secured to and upstanding from one of said marginal portions, second and third upstanding walls, pivot means pivotally supporting said second and third wall along first base upstanding marginal edges thereof from remote upstanding marginal edges of said stationary wall for swinging movement of second free upstanding marginal edges of the second and third walls remote from said first edges toward and away from closely juxtaposed positions, said first, second and third upstanding walls, when said second marginal edges are closely juxtaposed defining a peripherally enclosed mold cavity above said base with the lower marginal edge portions of the second and third walls extending along and disposed in reasonably good sealed relation with said second and third marginal portions, said base defining an upwardly opening socket centrally disposed relative to said cavity, an upstanding reinforcing member having its lower end received in said socket, an upper end portion of said reinforcing member including a plurality of vertically spaced horizontally outwardly projecting shanks supported therefrom, said second free upstanding marginal edges having a plurality of vertically spaced pairs of horizontally registered notches formed therein through which the outer ends of said shanks project, said first stationary upstanding wall being generally planar and including a first mold defining front side outwardly from which said first base upstanding marginal edges of said second and third upstanding sidewall project when said second free upstanding edges of said second and third upstanding walls are disposed in closely juxtaposed positions, said pivot means defining pivot axes for said second and third upstanding walls spaced to the rear of said front side and oppositely outwardly from said remote marginal edges of said first stationary upstanding wall, said first base upstanding marginal edges of said second and third upstanding walls overlying the marginal portions of said front side of said first upstanding wall when said second free upstanding edges of said second and third upstanding walls are disposed in closely juxtaposed positions, said outer end portions of said shanks including outwardly facing enlarged abutments threadedly adjustable thereon and abuttingly engaged with the inner surfaces of the portions of said second marginal edges disposed about said notches, and second abutments threaded upon said shanks and abutted against the outer surfaces of said second marginal edges disposed about said notches.

2. The mold of claim 1 including an anchor member carried by the upper end of said reinforcing member by which said reinforcing member and a cementitious casement disposed thereabout may be lifted from above.

3. The mold of claim 1 wherein generally horizontally registered remote wall portions of said mold include horizontal openings formed therethrough, and a tubular sleeve disposed within said cavity and having its opposite ends projecting through said openings.

4. The mold of claim 3 wherein said reinforcing member extends vertically through said sleeve.

5. The mold of claim 4 wherein said sleeve is longitudinally straight.

6. The mold of claim 3 wherein said sleeve is generally L-shaped in horizontal plan, said cavity being generally equiquadrangular in horizontal cross section, the opposite ends of said sleeve opening through adjacent sides of said mold.

7. The mold of claim 1 wherein one of the wall portions of said mold includes a horizontal opening formed therethrough, a sleeve disposed in said cavity having one inner closed end secured to said reinforcing member and an outer open end opening outwardly through said opening.

8. The mold of claim 7 wherein a wall portion of said mold opposite the wall portion thereof having an opening formed therein is also provided with a horizontal opening registered with the first mentioned opening and a second sleeve is disposed in said cavity including an inner closed end anchored relative to said reinforcing member and an outer open end opening outwardly through the second mentioned opening.

9. The mold of claim 8 wherein said mold includes a third wall portion extending between the last two mentioned opening equipped wall portions also having a horizontal opening formed therein and a third sleeve is provided including an inner end anchored relative to said reinforcing member and an open outer end opening outwardly through the last mentioned opening.

10. A mold in which to cast cementitious posts, said mold including a base having first, second and third adjoining marginal portions extending about said base, a first stationary upstanding wall fixedly secured to and upstanding from one of said marginal portions, second and third upstanding walls, pivot means pivotally supporting said second and third walls along base upstanding marginal edges thereof from remote marginal edges of said stationary wall for swinging movement of second free standing marginal edges of said second and third walls remote from said first edges toward and away from closely juxtaposed positions, said first, second and third upstanding walls, when said second marginal edges are closely juxtaposed, defining a peripherally enclosed upstanding mold cavity above said base with the lower marginal edge portions of said second and third walls overlying and disposed in reasonably good sealed relation with said second and third marginal portions, said first stationary upstanding wall being generally planar and including a first mold defining front side outwardly from which said first base upstanding marginal edges of said second and third upstanding wall project when said free upstanding edges of said second and third upstanding walls are disposed closely juxtaposed, said pivot means defining pivot axes for said second and third upstanding walls spaced to the rear of said front side and oppositely outwardly from said remote marginal edge of said first stationary upstanding wall, said pivot means also including means operative to enable vertical shifting of said second and third walls relative to said stationary wall and base, the weight of said second and third walls serving downwardly bias said second and third walls with the lower edges thereof tightly frictionally engaged with the upper surfaces of said base defining said second and third marginal portions to thereby effectively increase the fluid seal between said base and the lower ends of said second and third walls.

11. The mold of claim 7 including latch means for releasably latching the second marginal edges of said second and third walls in closely juxtaposed positions.

12. The mold of claim 7 wherein the portions of said second and third walls bounding said cavity are generally L-shaped in horizontal section, said cavity being generally equiquadrangular in horizontal cross section.

* * * * *